US006888294B1

(12) United States Patent
Meyer et al.

(10) Patent No.: US 6,888,294 B1
(45) Date of Patent: May 3, 2005

(54) FIELD EMISSION DEVICE USING A REDUCING GAS AND METHOD FOR MAKING SAME

(75) Inventors: Robert Meyer, Saint Nazaire les Eymes (FR); Jean-François Boronat, Grenoble (FR); Michel Levis, Seyssinet Pariset (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/959,391

(22) PCT Filed: Apr. 26, 2000

(86) PCT No.: PCT/FR00/01101

§ 371 (c)(1),
(2), (4) Date: Oct. 24, 2001

(87) PCT Pub. No.: WO00/67285

PCT Pub. Date: Nov. 9, 2000

(30) Foreign Application Priority Data

Apr. 28, 1999 (FR) ..... 99 05361

(51) Int. Cl.[7] ..... H01J 61/26

(52) U.S. Cl. ..... 313/309; 313/495; 313/496; 313/497; 313/547; 313/549; 313/561; 313/562; 445/24; 445/25; 445/41; 417/48; 417/49; 417/50; 417/51

(58) Field of Search ..... 313/309, 495, 313/547, 549, 551, 553, 563, 306, 307; 445/24, 25, 38; 417/48–51

(56) References Cited

U.S. PATENT DOCUMENTS 3,552,818 A 1/1971 Benda
5,275,840 A * 1/1994 Mikami et al. ..... 427/66
5,688,708 A * 11/1997 Kato et al. ..... 445/25
5,788,551 A * 8/1998 Dynka et al. ..... 445/25
5,964,630 A * 10/1999 Slusarczuk et al. ..... 445/25
6,100,627 A * 8/2000 Carretti et al. ..... 313/309
6,136,670 A * 10/2000 Blalock et al. ..... 438/471
6,268,288 B1 * 7/2001 Hautala et al. ..... 438/680
6,465,952 B1 * 10/2002 Itoh et al. ..... 313/549

FOREIGN PATENT DOCUMENTS

| | | |
|---|---|---|
| EP | 0036681 | 9/1981 |
| EP | 0609815 A1 | 8/1994 |
| WO | WO 96/01492 | 1/1996 |
| WO | WO 98/28769 | 7/1998 |

OTHER PUBLICATIONS

Nikko Kinzoku KK, "Manufacture for Metal Material to be Produced by Melting, Apparatus Therefor and Tungsten–Series Metal Material", Publication #09003559, Publication Date: Jul. 01, 1997, 1 page.

* cited by examiner

*Primary Examiner*—Nimeshkumar D. Patel
*Assistant Examiner*—Sikha Roy
(74) *Attorney, Agent, or Firm*—Thelen Reid & Priest, LLP

(57) ABSTRACT

The invention concerns a device comprising at least one field effect electron source within a sealed structure, which encompasses an internal space that contains a reducing gas whose purpose is to prevent oxidation of the emissive material of the electron source, whereby the reducing gas is a gas with the formula $N_xH_y$ where x=1 or 2 and y=3 or 4, and which is advantageously under a pressure of between $10^{-8}$ and $10^{-1}$ mbar. It also concerns manufacturing processes for such a device and apparatuses for implementing these processes.

33 Claims, 2 Drawing Sheets

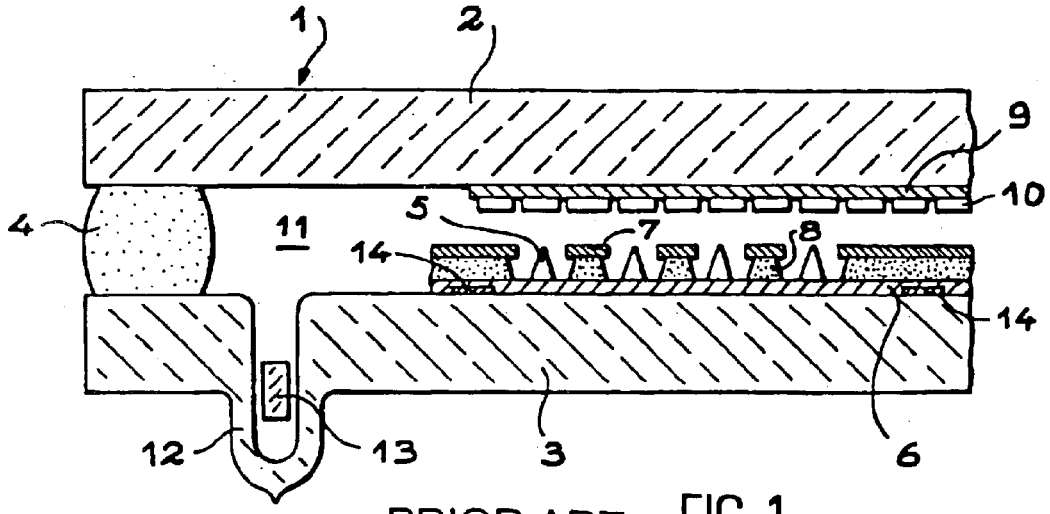
PRIOR ART FIG. 1
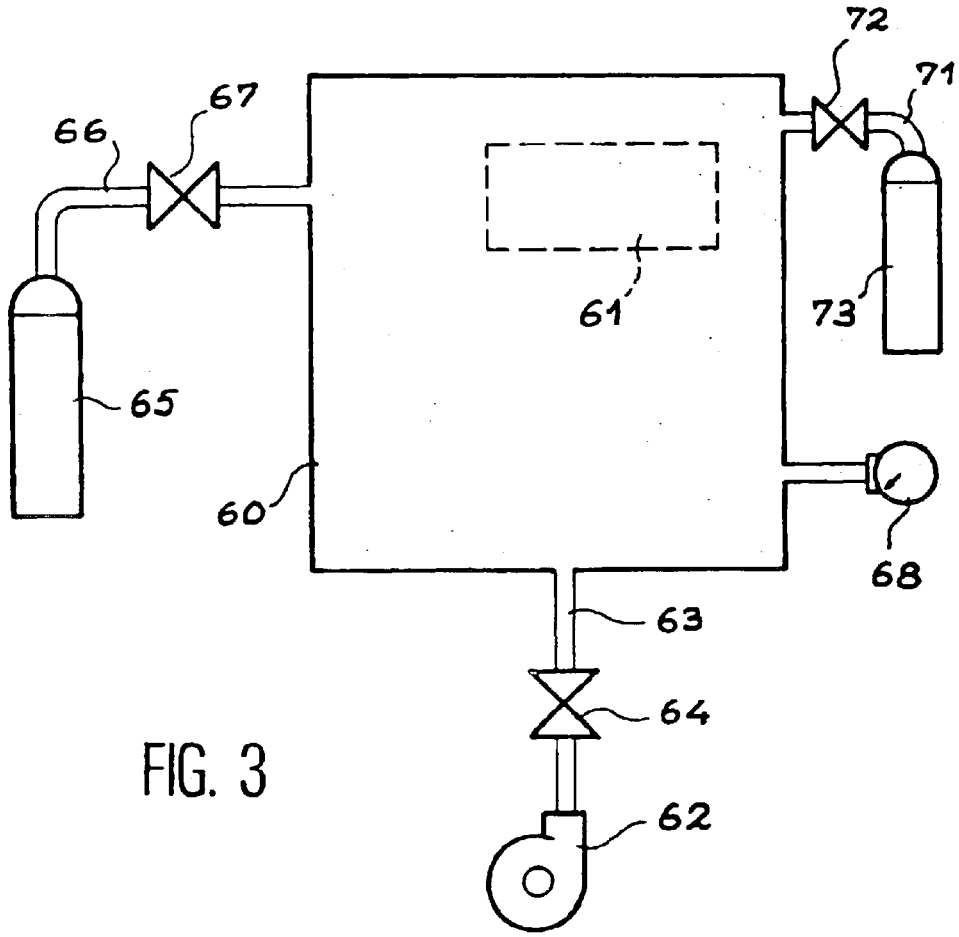
FIG. 3

FIELD EMISSION DEVICE USING A REDUCING GAS AND METHOD FOR MAKING SAME

This application is a national phase of PCT/FR00/01101 which was filed on Apr. 26, 2000, and was not published in English.

TECHNICAL ASPECTS

In a general manner, the present invention concerns a device that uses a field effect electron source (for example, a microdot device) and, more particularly, a field emission device, for example a flat, cathodo-luminescence display screen that is stimulated by field emission, or cold emission, using microdots. It also concerns the manufacture of such a device.

More precisely, the invention involves creating a reducing atmosphere within the interior of the device in order to prevent the oxidation of the microdots (or other electron emitting elements) when the device is working.

PRIOR TECHNICAL ART

Microdot screens are flat cathode ray tubes that operate under vacuum. These screens comprise a cathode (notably made out of cathodic conductors, grids and microdots) and an anode (made out of conductors and luminophors). In order to maintain the vacuum, an element known as a getter is used, as is the case with conventional cathode ray tubes. A getter is an element that, once it has been activated by heating under vacuum, can fix the gases desorbed by the device and maintain the vacuum level required for the device to work properly.

FIG. 1 shows a partial, cross-sectional view of a microdot screen 1 according to the prior art. It comprises two glass strips 2 and 3, which are placed opposite each other. The strips 2 and 3 are sealed in place around their edges by means of a glass paste 4 with a low melting point. The strip 3 bears, on its internal screen side, the cathode, which is made up of microdots 5, which are preferably formed on a resistive layer, such as a layer of silicon 6 deposited on the cathodic conductors 14, and grid electrodes 7, separated from the resistive layer 6 by a layer 8 made out of dielectric material. The strip 2 bears, on its internal screen side, the anode, which is made out of one or several conductive layers 9, bearing one or several luminophors 10. Thus, between the strips 2 and 3, there is a space 11, which is isolated from the exterior. This space 11 is maintained under vacuum. The vacuum is obtained by means of an exhaust tube 12, which is formed in the strip 3. The exhaust tube 12 is initially open and connected up to a vacuum pump. It thus allows one or several getters, such as getter 13, to be introduced. Once a vacuum has been obtained, the exhaust tube 12 is sealed off, as shown in FIG. 1.

The operational life time of these devices depends, amongst other things, on the life time of the cathodes, which is linked to the drop in the electron current over time. The life time of the cathodes depends, to a large extent, on the amount and type of residual gases that are present in the sealed structure that constitutes the screen.

When a microdot screen of this type is under operation, the electronic bombardment of the anode produces gases through a de-gassing effect, which is very dependent on the type of luminophors used to make up the anode. It has now been clearly demonstrated that the drop in the electron current emitted by the cathode is mainly caused by oxidation of the emissive material that is used in the microdots. This oxidation, caused by the desorbed gases, is particularly noticeable when the microdots are made out of molybdenum.

Depending on the type of luminophors used, this oxidation is more or less severe. In the case of colour screens, which use three different luminophors to obtain emissions in the red, green and blue, the oxidation is generally high and leads to short operational life times, of less than 100 hours.

Therefore, one aims to avoid oxidation of the emissive material. Three approaches may be used to attempt to solve this problem.

According to a first approach, the use of an emissive material that is insensitive to oxidation could be envisaged. This is a long term approach because, at the moment, only molybdenum can be used for making operational cathodes.

According to a second approach, a material that is sensitive to oxidation, such as molybdenum could be used, in the presence of non-oxidisable luminophors. This is possible in the case of monochromic screens by using ZnO as a luminophor. However, in the case of colour screens, this imposes very severe constraints as regards the choice of luminophors and is today very costly.

According to a third approach, a material sensitive to oxidation (such as molybdenum) could be used in the presence of oxidisable luminophors, but by creating, within the interior volume of the screen, a reducing atmosphere that can prevent this oxidation occurring and which can thus maintain the emissive material in its most favourable state. This third approach is particularly interesting, because it allows molybdenum to be used as the emissive material, while at the same time allows a wide choice as regards the type of luminophor.

In conventional applications, the role of a getter is to maintain the vacuum, in other words, to replace a vacuum pump. In the case of field emission flat screens, it has been suggested that a getter is used to carry out two functions: to evacuate the oxidative gases (which is its normal role) and to maintain a partial pressure of hydrogen.

The SAES GETTERS S.P.A. Company, which is specialised in the manufacture of getters, has developed and described materials that are capable of fulfilling this double role. Thus, its patent application WO-A-96/01492 discloses an application process that comprises the following steps:

- making a getter absorb a sufficient and controlled amount of hydrogen in a special enclosure,
- introducing the said hydrogenated getter into the flat screen before the flat screen is assembled, and
- assembling the screen while heating it for around 20 minutes at around 450° C. in order to free the hydrogen within the interior of the screen.

Document FR-A-755 295 describes an improvement to this process in order to solve the problem of hydrogen loss during the screen assembly phase.

A hydrogen atmosphere effectively makes it possible to stabilise the current in trichromic screens for several thousand hours. However, this hydrogen based process has the following disadvantages.

The getters that are able to maintain a sufficient pressure of hydrogen are specific and have a relatively low evacuating capacity as regards other oxidising gases. The quantity of getter that needs to be introduced is high (around 0.5 g for a 5 inch screen), which can lead to cost and cluttering problems, especially when large screens are involved.

In addition, the amount of hydrogen that the getter has to adsorb beforehand is quite considerable (1333 $cm^3$. Pa to 13330 $cm^3$. Pa, i.e. 10 to 100 $cm^3$. Torr per gram of getter), which, given the volume of the screen, can lead to the manufacturer having to assemble the screen under a hydrogen pressure close to atmospheric pressure.

These conditions are difficult to implement in industrial conditions and, in particular, pose difficult safety problems, which can only be overcome by resorting to costly solutions.

PRESENTATION OF THE INVENTION

According to the present invention, it is proposed that the disadvantages of the prior art may be overcome by using a $N_xH_y$ type gas, preferably ammonia $NH_3$, as a reducing gas instead of hydrogen. A partial pressure of $NH_3$ makes it possible to avoid the oxidation of the dots and thus to ensure that the cathodes have a long operational life.

This gas $N_xH_y$ is not evacuated, or is only evacuated to a very small extent, by the getters and is therefore compatible with getters known to those skilled in the art, which have very good evacuating characteristics. It has, in addition, the advantages of having very low toxicity, is non-explosive and presents no safety problems. It is therefore easy to use industrially.

A first objective of the invention consists in a device comprising at least one field effect electron source within a sealed structure, which encompasses an internal space that contains a reducing gas, whose purpose is to prevent oxidation of the emissive material of the electron source, whereby the reducing gas is a gas with the formula $N_xH_y$, or a gaseous mixture based on $N_xH_y$, where x=1 and y=3 or x=2 and y=4. Advantageously, the reducing gas is under a pressure of between $10^{-8}$ mbar and $10^{-3}$ mbar and, preferably, under a pressure of between $10^{-8}$ mbar and $10^{-5}$ mbar.

Preferably, the gas with formula $N_xH_y$ is $NH_3$.

In addition, the device may comprise one or several getters that are in communication with the internal space of the device.

The sealed structure may be made out of a first strip that bears a microdot cathode on its internal structural face, a second strip placed opposite the first strip and bearing an anode on its internal structural face, and means for sealing the first strip to the second strip around their edges. Luminophors may, in addition, be spread out on the anode. It may, for example comprises a flat display screen.

A second objective of the invention consists in a manufacturing process for this type of device, which comprises the following stages:

- the various parts that make up the device are assembled in order to obtain the said sealed structure, with at least one exhaust tube connected to the said internal space being provided,
- the evacuation exhaust tube is connected to an apparatus provided with the means for producing a vacuum and injecting the said reducing gas,
- the said internal space is placed under vacuum by means of the vacuum apparatus,
- the device is heated to a temperature and for sufficient time to allow it to be de-gassed, with the said internal space being maintained under vacuum,
- the vacuum apparatus is stopped
- the said reducing gas is introduced to the desired pressure into the said internal space by means of the apparatus for injecting the reducing gas,
- the exhaust tube is sealed off.

A third objective of the invention consists in another manufacturing process for this type of device, comprising the following stages:

- the various parts that make up the device are assembled in order to obtain the said sealed structure, with at least one evacuation exhaust tube that connects to the said internal space being provided,
- the exhaust tube is connected up to an apparatus provided with the means for producing a vacuum and injecting the said reducing gas,
- the said internal space is placed under vacuum using the means for providing a vacuum,
- the device is heated up to a temperature for sufficient time to allow it to be de-gassed, with the said internal space being maintained under vacuum,
- the said reducing gas is introduced to the desired pressure into the said internal space by means of the apparatus for injecting the reducing gas, with the vacuuming still being maintained,
- the exhaust tube is sealed off.

For both of these processes, if the device comprises means for sealing at high temperature, the assembly stage is carried out under vacuum or under a controlled atmosphere, by heating up to the activation temperature of the means used for sealing. Advantageously, once the heating stage is finished, the device is cooled down to ambient temperature and operated for a given time before the other stages are carried out. The processes may, in addition, include the following stages:

- the introduction of at least one getter into the exhaust tube before it is connected up to the said device,
- the activation of the getter before or after the introduction of the reducing gas.

The getter may also be activated after the exhaust tube has been sealed off.

A fourth objective of the invention consists in an apparatus for implementing these two processes, comprising:

- a pipe that can be connected up to the said exhaust tube by one of its ends.
- an apparatus for providing a vacuum, which is connected up to the other end of the pipe via a first valve,
- a source of $N_xH_y$ that is connected up to the said pipe by means of intermediate devices,
- an apparatus for measuring the pressure within the internal space of the device.

In order to implement the first process cited above, the intermediate devices may comprise a gas reservoir that is connected up to the said pipe via a second valve and to the source of $N_xH_y$ via a third valve, with an apparatus for measuring the pressure in the reservoir being provided.

In order to implement the second process cited above, the intermediate devices may simply comprise a valve.

A fifth objective of the invention consists in another manufacturing process for a device of this type, comprising the following stages:

- the various parts that make up the device are placed in position in relation to each other in an airtight enclosure, in order to obtain the said sealed structure, with the device being equipped with the means for sealing at high temperature,
- the interior of the airtight enclosure is placed under vacuum using the vacuum apparatus,
- the various parts that make up the device, placed in position in the airtight enclosure, are heated up with the vacuum being maintained in the airtight enclosure, and the various parts are heated up to a temperature and for sufficient time to allow them to be de-gassed, if appropriate, the vacuum apparatus is stopped, the said reducing gas is introduced into the interior of the airtight enclosure at the pressure desired for the internal space of the device, the device is assembled by sealing by heating up the means used for sealing.

A sixth objective of the invention consists in still another manufacturing process for this type of device, comprising the following stages:

the various parts that make up the device are placed in relation to each other in an airtight enclosure in order to obtain the said sealed structure, with the device being provided with the means for sealing at high temperature, and a hole being provided in the device for the purpose of communicating with the internal space of the device and the interior of the airtight enclosure, the interior of the airtight enclosure is placed under vacuum or a controlled atmosphere using appropriate means, the various parts that make up the device, placed in position in the airtight enclosure, are heated up with the vacuum or controlled atmosphere being maintained within the airtight enclosure, and the various parts are heated up to a temperature and for sufficient time to allow them to be de-gassed, the device is assembled by sealing by heating up the means used for sealing, with the vacuum or controlled atmosphere within the interior of the airtight enclosure being maintained, if appropriate, the interior of the airtight enclosure is placed under vacuum if it is not yet under vacuum, the said reducing gas is introduced into the interior of the airtight enclosure in order to obtain the desired pressure within the internal space of the device, the said connecting hole is sealed off. In this case, the heating and assembly stages may be carried out simultaneously.

A seventh objective of the invention consists in a device for implementing these two latter processes, comprising:

an airtight enclosure that is capable of encompassing the said device, an apparatus for providing a vacuum, connected to the interior of the enclosure via a first valve, a source of $N_xH_y$ that is connected to the interior of the enclosure via a second valve, an apparatus for measuring the pressure within the interior of the enclosure.

If necessary, this device can also comprise, in addition, an apparatus for producing a controlled atmosphere that is connected to the interior of the enclosure via a third valve, linked to the apparatus for producing a controlled atmosphere, for example a suitable gas cylinder.

BRIEF DESCRIPTION OF THE DRAWINGS

The invention will be more clearly understood and other advantages and distinctive features will become apparent from the following description, given as a non-limiting example, accompanied by the drawings in the appendix, including:

FIG. 1, which has already been described, is a partial, cross-sectional schematic view of a microdot display screen according to the prior art, FIG. 3 is a schematic view of second apparatus for implementing another manufacturing process for a device according to the present invention.

DETAILED DESCRIPTION OF THE MEANS FOR IMPLEMENTING THE INVENTION

Figure 2:
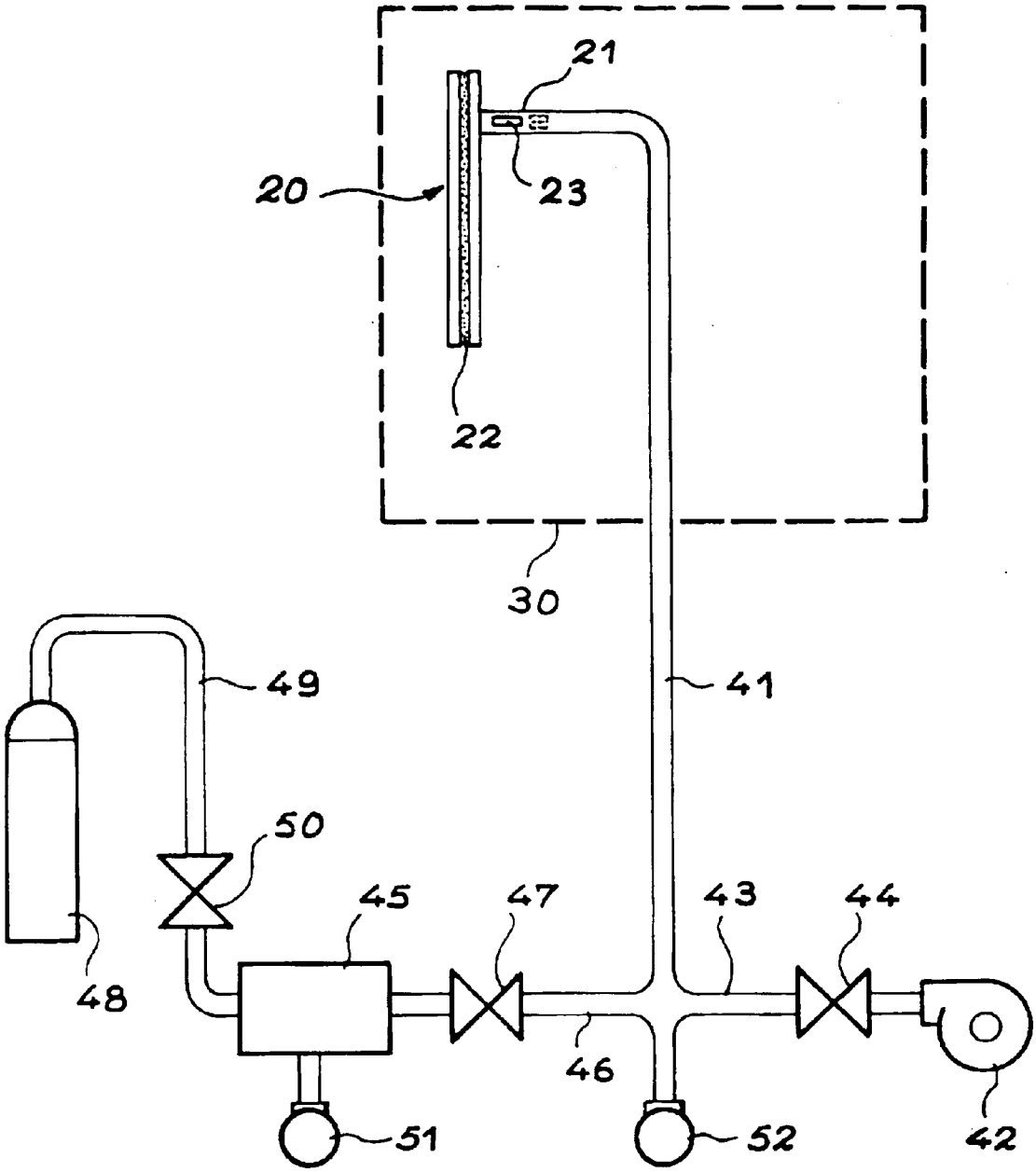
FIG. 2 is a schematic view of a first apparatus for implementing a manufacturing process for a device according to the present invention.

According to the invention, the specific choice of $N_xH_y$ gas, or a mixture of gases based on $N_xH_y$, makes it possible to both prevent the oxidation of the emissive material of the electron source and, at the same time, to avoid deposits on the emissive material. In fact, any decomposition of this gas takes place in the gaseous form, unlike other types of reducing gas ($CH_4$, $H_2S$ for example).

Several examples for manufacturing a device according to the invention will now be described.

Amongst the various types of getters that could be used, those commercialised by the S.A.E.S GETTERS S.p.A. Company, for example:

the "flashable" barium getter, with the registered trade name ST 14, the zirconium getter, which can be activated at high temperature (around 800° C.), with the registered trade name ST 171, the zirconium-iron getter, which can be activated at low temperature (around 400° C.), with the registered trade name ST 122.

EXAMPLE 1

A microdot screen 20, of the type shown in FIG. 1, for example 6 inches (15.25 cm) diagonal width, is assembled under vacuum or under a controlled atmosphere by heating to a temperature between 450° C. and 500° C. for around 1 hour. It is equipped with at least one open evacuation exhaust tube 21. The sealing layer 22 for the two strips of the device is made out of low melting point glass, called "frit glass".

After sealing and returning to atmospheric pressure, at least one getter 23, for example an ST 171 type getter, is introduced into the interior of the exhaust tube 21.

The device 20 is then placed in the zone 30 of the apparatus shown in FIG. 2, which allows it to be heated. The exhaust tube 21 is connected to a pipe 41, which allows it to be connected up to a turbo-molecular type vacuum pump 42 via a pipe 43, fitted with a valve 44 on one side and at the exit orifice by a gas reservoir 45, of known volume (for example 1.7 liters), via a pipe 46, fitted with a valve 47 on the other side.

An $NH_3$ gas cylinder 48 is connected to the entry orifice of the reservoir 45 via a pipe 49, fitted with a valve 50. This valve 50 is a needle valve that allows easy adjustment of the flow.

The apparatus set up in this way is also fitted with a gauge 51, that allows the pressure of gas within the reservoir 45 to be measured, and a gauge 52 that allows the pressure at the exit of the screen 20 to be measured.

The following procedure is then followed:

The screen 20 and the reservoir 45 are put under vacuum using the vacuum pump 42, with the valves 44 and 47 open and the valve 50 closed. The screen 20 is then heated up to 360° C. for 16 hours. After cooling down to ambient temperature, the screen 20 is operated for 20 hours. Once this operating stage, which allows the luminophors to be de-gassed, is finished, the getter 23 (or the getters) is activated by radio-frequency heating to a temperature of 800° C. for 4 minutes.

The reservoir 45 is then isolated by closing valve 47. Ammonia is then introduced into the reservoir 45.

The screen 20 is then isolated from the vacuum pump 42 by closing the valve 44. The valve 47 is then opened and ammonia is introduced into the screen 20 at an equilibrium pressure, which depends on the quantity introduced into the reservoir 45 and which is preferably between $10^{-3}$ and $10^{-5}$ mbar. The screen 20 may then be isolated from the apparatus by sealing off the exhaust tube 21.

EXAMPLE 2

According to a variation of example 1, $NH_3$ may be introduced into the screen under dynamic conditions.

In order to do this, once the getter activation phase is finished, a partial pressure of $NH_3$ is adjusted via valve 50, with valves 44 and 47 open.

The partial pressure of $NH_3$ is preferably between $10^{-8}$ and $10^{-5}$ mbar. After a period of dynamic scanning lasting several minutes to several tens of minutes, the screen is isolated from the apparatus by sealing off the exhaust tube.

EXAMPLE 3

According to another implementation method, the screen may be assembled in an integral manner, in other words, the screen is de-gassed then sealed under vacuum or under a controlled atmosphere. The process is such that, after sealing, it remains under vacuum, or under a controlled atmosphere, unlike the previous case (examples 1 and 2) in which, after sealing, the screen is returned to atmospheric pressure and then re-evacuated and heated.

The following procedure may then be followed.

The various parts of the screen (strip bearing the cathode, strip bearing the anode, frit glass, getters, etc.) are placed in position under vacuum then heated to a temperature of around 300° C. to 450° C. for one or several hours. The getters may be placed in position either within the interior of the screen or in an external area such as a sealed off exhaust tube or getter box. During the heating stage, the anode may be laid flat against the cathode or maintained at a certain distance from the cathode. In the latter case, the de-gassing is more efficient.

These operations are carried out in an apparatus schematically shown in FIG. 3, which comprises an airtight enclosure 60 that allows the field emission device to be heated and assembled. This enclosure 60 is equipped with appropriate electrical and mechanical devices 61 that allow the device to be assembled and heated.

The apparatus shown in FIG. 3 is also equipped with a turbo-molecular vacuum pump 62 that is connected to the interior of the enclosure 60 via a pipe 63, fitted with a valve 64. A cylinder of $NH_3$ 65 is connected to the interior of the enclosure 60 via a pipe 66, fitted with a valve 67. A gauge 68 allows the pressure within the airtight enclosure 60 to be measured. A pipe 71, fitted with a valve 72, also connects the interior of the enclosure 60 to a cylinder 73, in the case where it is desired to place the interior of the enclosure under a controlled atmosphere.

After the heating stage, $NH_3$ is introduced into the enclosure 60 containing the screen at a pressure of between $10^{-3}$ and $10^{-3}$ mbar.

If the anode and cathode strips are not already in contact, they are brought into contact by means of the frit glass, and the screen is sealed under the $NH_3$ pressure established beforehand at a temperature of between 450° C. and 500° C.

Depending on the type of getter used, the getter must, or must not, be "flashed" or activated after sealing and returning to ambient temperature. It may be advantageous to use a ST 122 type getter, which may be activated during the assembly stage.

EXAMPLE 4

According to a variation of the embodiment described in Example 3, one of the parts of the screen (the cathode strip, the anode strip, the getter box) comprises a hole, with a diameter of around 1 millimeter or several millimeters, which allows the interior of the screen and the airtight enclosure 60 to be connected together.

As in Example 3, the various parts of the screen are placed in position under vacuum and then heated.

The sealing stage may be carried out at this time under a controlled atmosphere, which is advantageous when a borosilicate type glass is used for the screen strips, and the enclosure is re-evacuated after the screen has been assembled.

This type of embodiment may be advantageous even when the sealing is carried out under vacuum, because all of the products de-gassed within the interior of the screen during sealing are removed, which makes it possible to obtain a better vacuum within the interior of the screen.

After the sealing stage and, if necessary, cooling and re-evacuating, $NH_3$ at a pressure of between $10^{-3}$ and $10^{-3}$ mbar is introduced into the enclosure and, as a consequence, into the screen. The hole connecting the screen and the enclosure is then sealed by any appropriate means.

In this type of embodiment, it may be advantageous to use the same getters as in Example 3.

What is claimed is:

1. A device (1) comprising at least one field effect electron source (5) within a sealed structure, which encompasses an internal space (11) that contains a reducing gas whose purpose is to prevent oxidation of the emissive material of the electron source, whereby the reducing gas comprises a gas with the formula $N_xH_y$ where x=1 or 2 and y=3 or 4.

2. A device according to claim 1, whereby the reducing gas is under a pressure of between $10^{-8}$ and $10^{-3}$ mbar.

3. A device according to claim 2, whereby the reducing gas is under a pressure of between $10^{-8}$ and $10^{-5}$ mbar.

4. A device according to claim 3, whereby the gas with formula $N_xH_y$ is $NH_3$.

5. A device according to claim 1, whereby the gas with formula $N_xH_y$ is $NH_3$.

6. A device according to claim 5, whereby it comprises, in addition, one or several getters (13) that are in connected to the internal space (11) of the device (1).

7. A device according to claim 1, whereby it comprises, in addition, one or several getters (13) that are in connected to the internal space (11) of the device (1).

8. A device according to any of claim 7, whereby the said sealed structure comprises a first strip (3) bearing a microdot cathode (5) on its internal structural face, a second strip (2) placed opposite the first strip (3) and bearing an anode (9) on its internal structural face, and the means (4) of sealing the first strip to the second strip around their edges.

9. A device according to claim 1, whereby the said sealed structure comprises a first strip (3) bearing a microdot cathode (5) on its internal structural face, a second strip (2) placed opposite the first strip (3) and bearing an anode (9) on its internal structural face, and the means (4) of sealing the first strip to the second strip around their edges.

10. A device according to claim 9, whereby it comprises, in addition, luminophors (10) spread out over the anode (9).

11. A manufacturing process for a device according to claim 10, comprising the following stages:

the various parts that make up the device (20) are assembled in order to obtain the said sealed structure, with at least one evacuation exhaust tube (21) connected to the said internal space being provided, the evacuation exhaust tube (21) is connected to an apparatus that is equipped with the means of providing a vacuum (42) and the means for injecting the said reducing gas (48), the said internal space is placed under vacuum by means of the vacuum apparatus (42), the device (20) is heated to a temperature and for sufficient time to allow it to be de-gassed, while the vacuum (42) in the said internal space is maintained, the said reducing gas is introduced to the desired pressure into the said internal space by means of the apparatus for injecting the reducing gas (48), with the vacuum apparatus (42) still operating, the exhaust tube (21) is sealed off.

12. A manufacturing process for a device according to claim 10, comprising the following stages:

the various parts that make up the device (20) are assembled in order to obtain the said sealed structure, it being provided with at least one evacuation exhaust tube (21) that is connected to the said internal space, the evacuation exhaust tube (21) is connected to an apparatus that is equipped with the means of providing a vacuum (42) and the means for injecting the said reducing gas (48), the said internal space is placed under vacuum by means of the vacuum apparatus (42)

the device (20) is heated to a temperature and for sufficient time to allow it to be de-gassed, while the vacuum in the said internal space is maintained, the vacuum apparatus (42) is stopped, the said reducing gas is introduced to the desired pressure into the said internal space by the apparatus for injecting the reducing gas, the exhaust tube (21) is sealed off.

13. A manufacturing process for a device according to claim 10, comprising the following stages:

the various parts making up the device are put in position in relation to each other within an airtight enclosure (60), in order to obtain the said sealed structure, with the device provided with the means for sealing at high temperature, the interior of the airtight enclosure (60) is placed under vacuum using the vacuum apparatus (62), the various parts making up the device, placed in position within the airtight enclosure (60), are heated with the airtight enclosure being kept under vacuum, and the heating being up to a temperature and for sufficient time to allow the various parts to be de-gassed, if necessary, the vacuum apparatus (62) is stopped, the said reducing gas is introduced into the interior of the airtight enclosure (60) at the pressure desired for the internal space of the device, the device is assembled by sealing by heating up the means used for sealing.

14. A manufacturing process for a device according to claim 10 comprising the following stages:

the various parts making up the device are placed in position in relation to each other within an airtight enclosure (60), in order to obtain the said sealed structure, with the device provided with the means for sealing at high temperature, and a hole being provided in the device whose purpose is to connect the internal space of the sealed structure and the airtight enclosure (60), the interior of the airtight enclosure (60) is placed under vacuum or a controlled atmosphere using appropriate means, the various parts making up the device, placed in position within the airtight enclosure (60), are heated with the airtight enclosure being kept under vacuum or under a controlled atmosphere, and the heating being up to a temperature and for sufficient time to allow the various parts to be de-gassed, the device is assembled by sealing by heating up the means used for sealing, with the vacuum or controlled atmosphere within the interior of the airtight enclosure (60) being maintained, if necessary, the interior of the airtight enclosure (60) is placed under vacuum, the said reducing gas is introduced into the interior of the airtight enclosure (60) in order to obtain the desired pressure within the internal space of the device, the connecting hole is sealed off.

15. A manufacturing process for a device according to claim 1, comprising the following stages:

the various parts that make up the device (20) are assembled in order to obtain the said sealed structure, it being provided with at least one evacuation exhaust tube (21) that is connected to the said internal space, the evacuation exhaust tube (21) is connected to an apparatus that is equipped with the means of providing a vacuum (42) and the means for injecting the said reducing gas (48), the said internal space is placed under vacuum by means of the vacuum apparatus (42), the device (20) is heated to a temperature and for sufficient time to allow it to be de-gassed, while the vacuum in the said internal space is maintained, the vacuum apparatus (42) is stopped, the said reducing gas is introduced to the desired pressure into the said internal space by the apparatus for injecting the reducing gas, the exhaust tube (21) is sealed off.

16. Process according to claim 15, whereby, with the device provided with the means for sealing at high temperature, the assembly stage takes place under vacuum or under a controlled atmosphere, through heating up to the temperature at which the means used for sealing is activated.

17. Process according to claim 16, whereby, once the heating stage is finished, the device (20) is cooled down to ambient temperature and operated for a given period before carrying out the other stages.

18. Process according to claim 15, whereby, once the heating stage is finished, the device (20) is cooled down to ambient temperature and operated for a given period before carrying out the other stages.

19. Process according to claim 18, whereby it comprises, in addition, the following stages:

the introduction of at least one getter (23) into the exhaust tube (21) before it is connected up to the said apparatus, the activation of the getter (23) before or after the introduction of the reducing gas.

20. Process according to claim 15, whereby it comprises, in addition, the following stages:

the introduction of at least one getter (23) into the exhaust tube (21) before it is connected up to the said apparatus, the activation of the getter (23) before or after the introduction of the reducing gas.

21. Process according to claim 20, whereby the getter is activated after the exhaust tube has been sealed off.

22. An apparatus for implementing the process according to claim 21, comprising:

a pipe (41) that can be connected up to the said exhaust tube (21) by one of its ends, means for providing a vacuum (42), connected up to the other extremity of the pipe (41) by means of a first valve (44), a source of $N_xH_y$ (48), connected to the said pipe (41) via intermediary devices, an apparatus (52) for measuring the pressure within the internal space of the device.

23. An apparatus for implementing the process according to claim 15, comprising:

a pipe (41) that can be connected up to the said exhaust tube (21) by one of its ends, means for providing a vacuum (42), connected up to the other extremity of the pipe (41) by means of a first valve (44), a source of $N_xH_y$ (48), connected to the said pipe (41) via intermediary devices, an apparatus (52) for measuring the pressure within the internal space of the device.

24. An apparatus according to claim 23, whereby the intermediate devices comprise a gas reservoir (45) connected to the said pipe (41) via a second valve (47) and to the source of $N_xH_y$ (48) be means of a third valve (50), with an apparatus (51) for measuring the pressure within the reservoir being provided.

25. An apparatus according to claim 23, whereby the intermediate devices comprise a valve.

26. A manufacturing process for a device according to claim 1, comprising the following stages:

the various parts that make up the device (20) are assembled in order to obtain the said seated structure, with at least one evacuation exhaust tube (21) connected to the said internal space being provided, the evacuation exhaust tube (21) is connected to an apparatus that is equipped with the means of providing a vacuum (42) and the means for injecting the said reducing gas (48), the said internal space is placed under vacuum by means of the vacuum apparatus (42), the device (20) is heated to a temperature and for sufficient time to allow it to be de-gassed, while the vacuum (42) in the said internal space is maintained, the said reducing gas is introduced to the desired pressure into the said internal space by means of the apparatus for injecting the reducing gas (48), with the vacuum apparatus (42) still operating, the exhaust tube (21) is sealed off.

27. Process according to claim 26, whereby, with the device provided with the means for sealing at high temperature, the assembly stage takes place under vacuum or under a controlled atmosphere, through heating up to the temperature at which the means used for sealing is activated.

28. A manufacturing process for a device according to claim 1, comprising the following stages:

the various parts making up the device are put in position in relation to each other within an airtight enclosure (60), in order to obtain the said sealed structure, with the device provided with the means for sealing at high temperature, the interior of the airtight enclosure (60) is placed under vacuum using the vacuum apparatus (62), the various parts making up the device, placed in position within the airtight enclosure (60), are heated with the airtight enclosure being kept under vacuum, and the heating being up to a temperature and for sufficient time to allow the various parts to be de-gassed, if necessary, the vacuum apparatus (62) is stopped, the said reducing gas is introduced into the interior of the airtight enclosure (60) at the pressure desired for the internal space of the device, the device is assembled by sealing by heating up the means used for sealing.

29. An apparatus for implementing the process according to claim 28, comprising:

an airtight enclosure (60) capable of encompassing the said device, a vacuum apparatus (62) connected to the interior of the enclosure via a first valve (64), a source of $N_xH_y$ (65) connected to the interior of the enclosure (60) via a second valve (67), an apparatus (68) for measuring the pressure within the interior of the enclosure (60).

30. An apparatus according to claim 29, whereby it comprises, in addition, the means for producing a controlled atmosphere, which is connected to the interior of the enclosure (60) via a third valve.

31. A manufacturing process for a device according to claim 1, comprising the following stages:

the various parts making up the device are placed in position in relation to each other within an airtight enclosure (60), in order to obtain the said sealed structure, with the device provided with the means for sealing at high temperature, and a hole being provided in the device whose purpose is to connect the internal space of the sealed structure and the airtight enclosure (60), the interior of the airtight enclosure (60) is placed under vacuum or a controlled atmosphere using appropriate means, the various parts making up the device, placed in position within the airtight enclosure (60), are heated with the airtight enclosure being kept under vacuum or under a controlled atmosphere, and the heating being up to a temperature and for sufficient time to allow the various parts to be de-gassed, the device is assembled by sealing by heating up the means used for sealing, with the vacuum or controlled atmosphere within the interior of the airtight enclosure (60) being maintained, if necessary, the interior of the airtight enclosure (60) is placed under vacuum, the said reducing gas is introduced into the interior of the airtight enclosure (60) in order to obtain the desired pressure within the internal space of the device, the connecting hole is sealed off.

32. Process according to claim 31, whereby the heating and assembly stages are carried out simultaneously.

33. An apparatus for implementing the process according to claim 32, comprising:

an airtight enclosure (60) capable of encompassing the said device, a vacuum apparatus (62) connected to the interior of the enclosure via a first valve (64), a source of $N_xH_y$ (65) connected to the interior of the enclosure (60) via a second valve (67), an apparatus (68) for measuring the pressure within the interior of the enclosure (60).

* * * * *